US005388609A

United States Patent [19]

Ghio et al.

[11] Patent Number: 5,388,609

[45] Date of Patent: Feb. 14, 1995

[54] HOSE REEL CART

[76] Inventors: Gary L. Ghio, 6117 Tremain Dr., Citrus Heights, Calif. 95621; Leroy F. Meidinger, 7130 Beech Ave., Orangevale, Calif. 95622

[21] Appl. No.: 178,109

[22] Filed: Jan. 6, 1994

[51] Int. Cl.[6] ..... B65H 75/40

[52] U.S. Cl. ..... 137/355.27; 137/355.28; 242/397

[58] Field of Search ..... 137/355.26, 355.27, 137/355.28; 242/397, 398, 407.1

[56] References Cited

U.S. PATENT DOCUMENTS

| | | | |
|---|---|---|---|
| 241,961 | 5/1881 | Gilbert | 242/86.2 |
| 357,900 | 2/1887 | Boyle | 137/355.28 |
| 613,515 | 11/1898 | Howard | 137/355.26 |
| 1,115,325 | 10/1914 | McCall | 242/86.2 |
| 2,590,963 | 4/1952 | Hannay | 242/86.2 |
| 2,635,008 | 4/1953 | Nelson | 137/355.26 |
| 2,636,747 | 4/1953 | Blackmond . | |
| 3,627,224 | 12/1971 | Diggs | 242/86.2 |
| 4,137,939 | 2/1979 | Chow . | |
| 4,228,553 | 10/1980 | Genuit | 137/355.27 |
| 4,306,688 | 12/1981 | Hechler, IV | 242/86 |
| 4,512,361 | 4/1985 | Tisbo et al. . | |
| 4,700,737 | 10/1987 | Nelson . | |
| 4,974,627 | 12/1990 | Nelson . | |
| 5,109,882 | 5/1992 | Eley . | |
| 5,211,351 | 5/1993 | DeClerck | 242/86.2 |

*Primary Examiner*—A. Michael Chambers
*Attorney, Agent, or Firm*—Jerry T. Kearns

[57] ABSTRACT

A hose reel cart includes a vertically disposed circular planar reel mounted at a slight incline to the vertical upon a tubular wheeled cart. Tapered guide pins extending perpendicularly outwardly from one face of the reel engage an end portion of a fire hose therebetween for removably securing the hose to the reel. A hand crank provides selective rotary drive to the reel via a chain and sprocket mechanism to flatten, drain, and coil a fire hose in overlying condition upon the reel. The tubular frame includes a forwardly extending hose guide which serves to align, drain, and flatten the hose and also functions as a ground engaging prop to support the cart. The ergonometric design of the cart allows a user to coil and remove a hose from the reel without bending or stooping, and without the use of tools.

15 Claims, 3 Drawing Sheets

HOSE REEL CART

BACKGROUND OF THE INVENTION

1. Field of the Invention

The present invention relates to hose storage reels, and more particularly pertains to a novel and improved hose reel cart for rolling hoses, particularly fire hoses, for storage.

2. Description of the Prior Art

Fire hoses such as those employed on fire apparatus must be rolled for storage after use. This task has heretofore involved manual rolling of the hoses on the ground by stooping firemen. This practice frequently causes strain and other injury to firemen's backs, due to the necessity of bending or stooping and the relatively heavy nature of the fire hoses.

A variety of reel devices have been proposed by the prior art for the rolling and rolled storage of hoses. These devices are typically designed for use with garden hoses. U.S. Pat. No. 2,636,747 which issued to P. Blackmond on Apr. 28, 1953 discloses a wheelbarrow in which the tub may be removed and replaced with a hose reel. U.S. Pat. No. 4,137,939 which issued to H. Chow on Feb. 6, 1979 discloses a hose reel cart including a reel mounted for manual rotation via a hand crank on a tubular frame. The frame has a pair of wheels for movement along the surface of the ground. U.S. Pat. No. 4,512,361 which issued to C. Tisbo et al. on Apr. 23, 1985 discloses a hand crank driven hose storage reel mounted on a wheeled plastic frame. U.S. Pat. No. 4,700,737 which issued to T. Nelson on Oct. 20, 1987 discloses a hand crank driven hose storage reel mounted on a tubular wheeled frame. U.S. Pat. No. 4,974,627 which issued to T. Nelson on Dec. 4, 1990 discloses a hose reel mounted on a plastic wheeled frame and including an elevated hand crank mechanism coupled for rotating the reel by a gear drive mechanism intended to obviate the need for a user to bend or stoop. U.S. Pat. No. 5,109,882 which issued to J. Eley on May 5, 1992 discloses a hose caddy including a hand crank driven reel mounted on a tubular frame and having an elongated U-shaped guide for aligning a hose on the reel.

The above-described prior art devices are intended for use with garden hoses, and are not suitable for use with fire hoses for several reasons. First, storage of a fire hose entails flattening the hose to drain water and rolling the flattened hose upon itself in an overlying coil, rather than upon a reel or spool. Second, storage of rolled fire hoses on separate reel mechanism is precluded by the great volume of space required. Third, fire hoses weigh much more than garden hoses, making it very difficult to "reel in" a fire hose for storage upon a stationary storage reel.

SUMMARY OF THE INVENTION

Accordingly, it is an object of the present invention to provide a new and improved hose reel cart which allows rolling of a hose in a flattened condition into an overlying coil.

It is a further object of the present invention to provide a new and improved hose reel cart which is of a durable and reliable construction.

An even further object of the present invention is to provide a new and improved hose reel cart which allows removal of a hose from the reel in a coiled condition.

Still another object of the present invention is to provide a new and improved hose reel cart including a hose guide disposed adjacent ground level for guiding and flattening a hose.

Yet another object of the present invention is to provide a new and improved hose reel cart including an offset reel for balancing the weight of rolled hose.

Even still another object of the present invention is to provide a new and improved hose reel cart including an ergonometrically designed frame to allow an individual to roll and store a heavy hose without stooping or bending.

A further object of the present invention is to provide a new and improved hose reel cart including holding pins for rapidly securing a hose to the reel and for allowing rapid removal of a hose from the reel in a coiled condition.

In order to achieve these and other objects of the invention, the present invention provides a novel and improved hose reel cart which includes a vertically disposed circular planar reel mounted at a slight incline to the vertical upon a tubular wheeled cart. Tapered guide pins extending perpendicularly outwardly from one face of the reel engage an end portion of a fire hose therebetween for removably securing the hose to the reel. A hand crank provides selective rotary drive to the reel via a chain and sprocket mechanism to flatten, drain, and coil a fire hose in overlying condition upon the reel. The tubular frame includes a forwardly extending hose guide which serves to align, drain, and flatten the hose and also functions as a ground engaging prop to support the cart. The ergonometric design of the cart allows a user to coil and remove a hose from the reel without bending or stooping, and without the use of tools.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figures 1, 2:
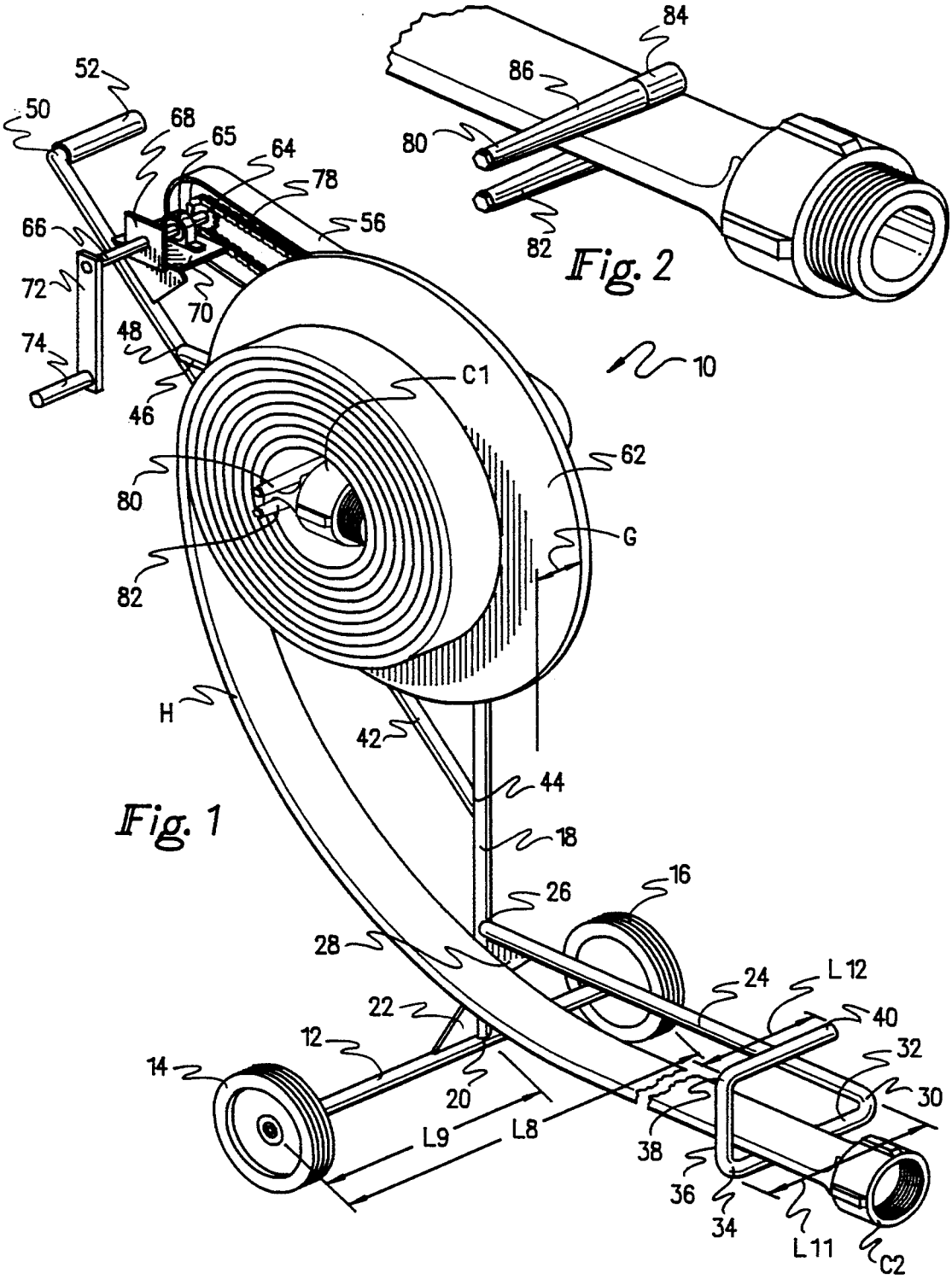
FIG. 1 is a perspective view of the hose reel cart according to the present invention with a fire hose rolled thereon.
FIG. 2 is a perspective detail view illustrating holding pins for securing an inner end of a fire hose to the hose reel.

Referring now to the drawings, wherein like reference numerals designate corresponding structure throughout the views, and referring in particular to FIGS. 1 through 6, an improved hose reel cart 10 according to a first preferred embodiment of the invention essentially comprises a hose reel mechanism mounted at an elevated position of a wheeled cart and adapted for manual rotation by means of a hand crank, gear, and chain drive mechanism. The cart includes an axle 12 mounting a pair of spaced wheels 14 and 16 for free rotation. A vertical standard 18 extends perpendicularly to the axle 12 and extends upwardly therefrom from a rigid connection 20 offset from the midpoint of the axle 12 toward the wheel 16 in order to balance the weight of a coiled fire hose H. The hose reel cart 10 may be constructed from metal tubular frame members secured by welding or other conventional fastening techniques. For example, a triangular reinforcement flange 22 in conjunction with welded connection 20 rigidly secures the standard 18 to the axle 12.

A hose guide support member 24 extends perpendicularly forwardly from a rigid connection 26, reinforced by a triangular flange 28, with the standard 18. A forward end of the hose guide support member 24 terminates at a ninety degree radiused bend 30 disposed in a horizontal plane and integrally formed with a horizontal hose support bar 32. The hose support bar 32 terminates in a ninety degree radiused bend 34 which forms an integral connection with a vertical hose restraint bar 36. The hose restraint bar 36 terminates at a ninety degree radius bend 38 which forms an integral connection with a hose entrapment member 40 disposed in parallel overlying relation with the support bar 32. As may now be readily appreciated, members 32, 36, and 40 define an open-ended rectangular guide channel for the purpose of supporting, flattening, draining, and guiding a fire hose H being coiled upon the hose reel. In addition to the function of guiding the hose, the hose guide assembly also serves as a ground engaging support or prop for the hose reel cart 10, particularly when a completely coiled hose is being removed from the hose reel.

A rear frame member 42 extending obliquely from a rigid connection 44 with the standard 18 intersects a brace member 46 at another rigid connection 48, and terminates at an upper end in a transverse handle bar 50. The handle bar 50 preferably includes a rubber or plastic handle grip covering 52 for the purpose of facilitating manual manipulation of the cart. The construction of the tubular frame is such that the tubular members 18, 24, 42, and 46 are all disposed in a common vertically extending plane.

Figure 4:
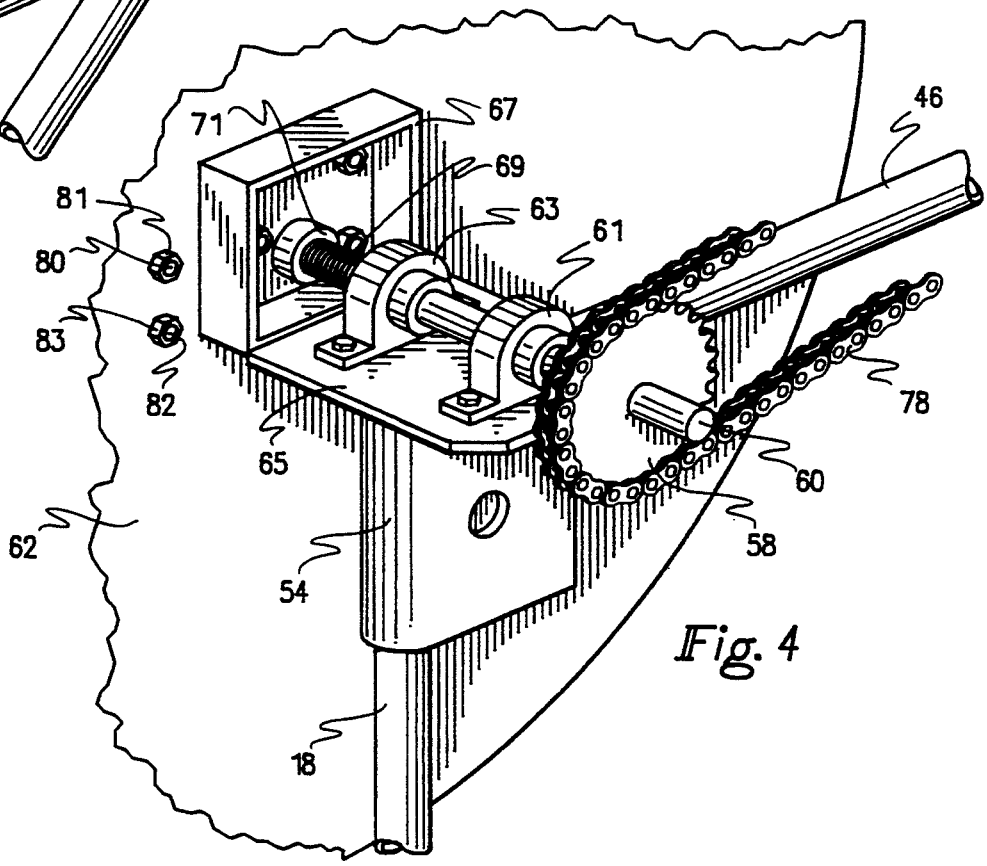
FIG. 4 is a perspective detail view of sprocket and chain drive components for rotating the hose reel.

A drive support bracket 54 connected rigidly to the standard 18 and the brace 46 detachably supports a chain guard 56 which shields a driven gear or sprocket 58 rotationally fixed to a driven shaft 60. As best shown in FIG. 4, a pair of bearing blocks 61 and 63 mounted on a support base 65 secured to the bracket 54 mount the shaft 60 for rotation about its central longitudinal axis. The driven shaft 60 terminates at an inner end opposite the sprocket 58 in a threaded portion 69 connected by a drive socket 71 to the hose reel 62. With reference to FIG. 1, the reel 62 comprises a relatively thin, planar, circular member mounted at a slight inclination G with respect to a vertical reference axis. The reel 62 may be formed from a variety of relatively rigid materials including wood, metal, plastic, fiberglass, etc. A housing 67 also fixed to the reel 62 mounts the drive socket 71.

Figure 3:
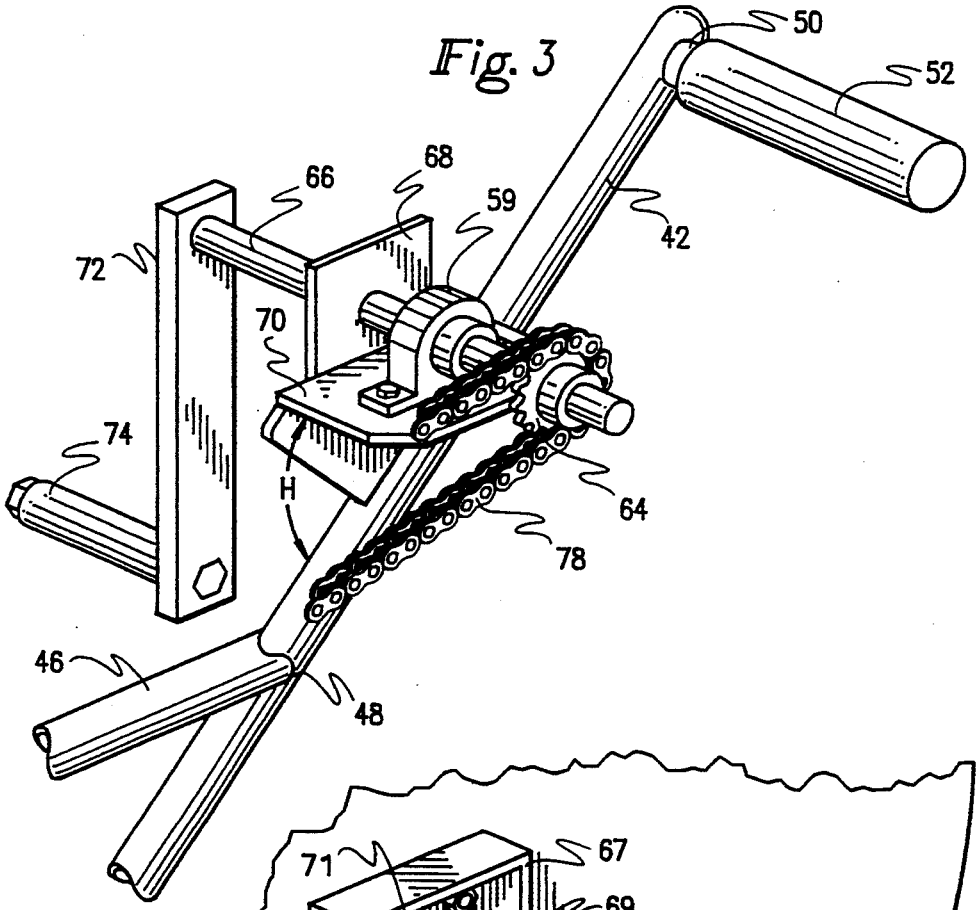
FIG. 3 is a perspective detail view illustrating hank crank and chain drive components for rotating the hose reel.
Figure 5:
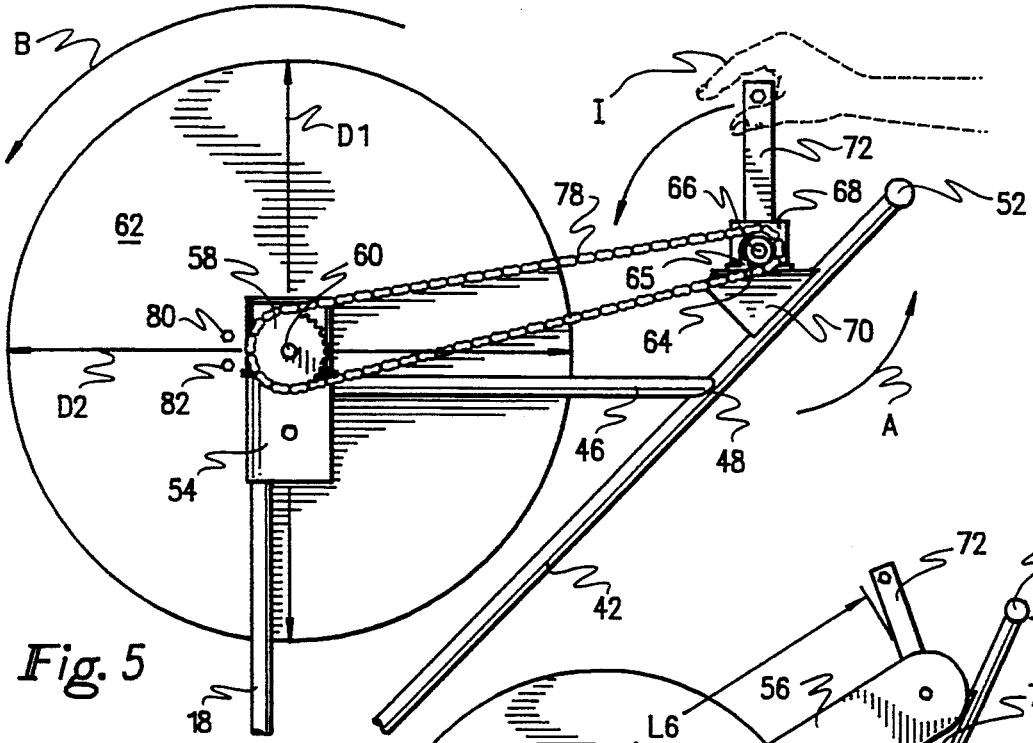
FIG. 5 is a partial side elevational view illustrating the hose reel chain drive components with the chain guard removed.

With reference to FIGS. 3 and 5, the manual drive input mechanism will now be described. A bearing block 59 mounted on a bracket 68 fixed to the rear frame member 42 rotatably supports a drive shaft 66 for the purpose of driving a drive gear or sprocket 64. A handle 74 connected to the drive shaft 66 by a crank arm 72 allows an individual I to effect manual rotation of the drive sprocket 64. Toward this end, the handle 74, or at least an outer sleeve portion thereof, is preferably mounted for rotation about its longitudinal central axis such that a user need not adjust his grip on the handle as the crank arm rotates. A drive chain 78 connects the drive sprocket 64 and the driven sprocket 58, which preferably provide a 1:2 gear ratio, such that manual rotation of the crank arm 72 for two complete revolutions in the direction indicated by arrow A will result in one complete revolution of the reel 62 in the direction indicated by arrow B, thus providing a sufficient mechanical advantage to facilitate the coiling of relatively heavy fire hoses H, while still maintaining a relatively fast rate of operation. As an alternative to the illustrated and described chain drive mechanism, a belt drive system or a direct or indirect gear system may also be employed.

As best shown in FIGS. 1 and 2, two drive pins 80 and 82 extend perpendicularly outwardly from one face of the reel 62 in spaced parallel relation for the purpose of detachably securing one end of a conventional fire hose H to the reel 62. As shown in FIG. 4, securement of the pins 80 and 82 to the reel 62 may be effected by use of nuts 81 and 83 engaging threaded end portions of the pins which extend through the reel 62. The hose H terminates at opposite ends in conventional couplings C1 and C2 in a conventional manner for the purpose of connecting the hose H to other fire fighting equipment such as other hoses, nozzles, pump outlets, hydrants, etc. The pins 80 and 82 each have a preferred total length of about 6.0 inches including base portions 84 of about 1.25 inches in length having a constant diameter of about 1.0 inches disposed adjacent to the reel 62. The outer free end portions 86 of the pins 80 and 82 taper frustoconically from the base portions 84 to a minimum outer diameter of about 0.625 inches. With reference to FIG. 5, the pins 80 and 82 are preferably disposed along a line extending parallel to and about 2.5 inches to the left of a vertical reference diameter D1. The pins 80 and 82 are also spaced apart about 1.625 inches on center, evenly spaced on opposite sides of a horizontal reference diameter D2. In a less preferred alternative, a variety of other shapes of spaced members may be employed in place of pins 80 and 82, with the salient feature being the provision of a space between the members dimensioned for insertion of the hose H therebetween.

Figure 6:
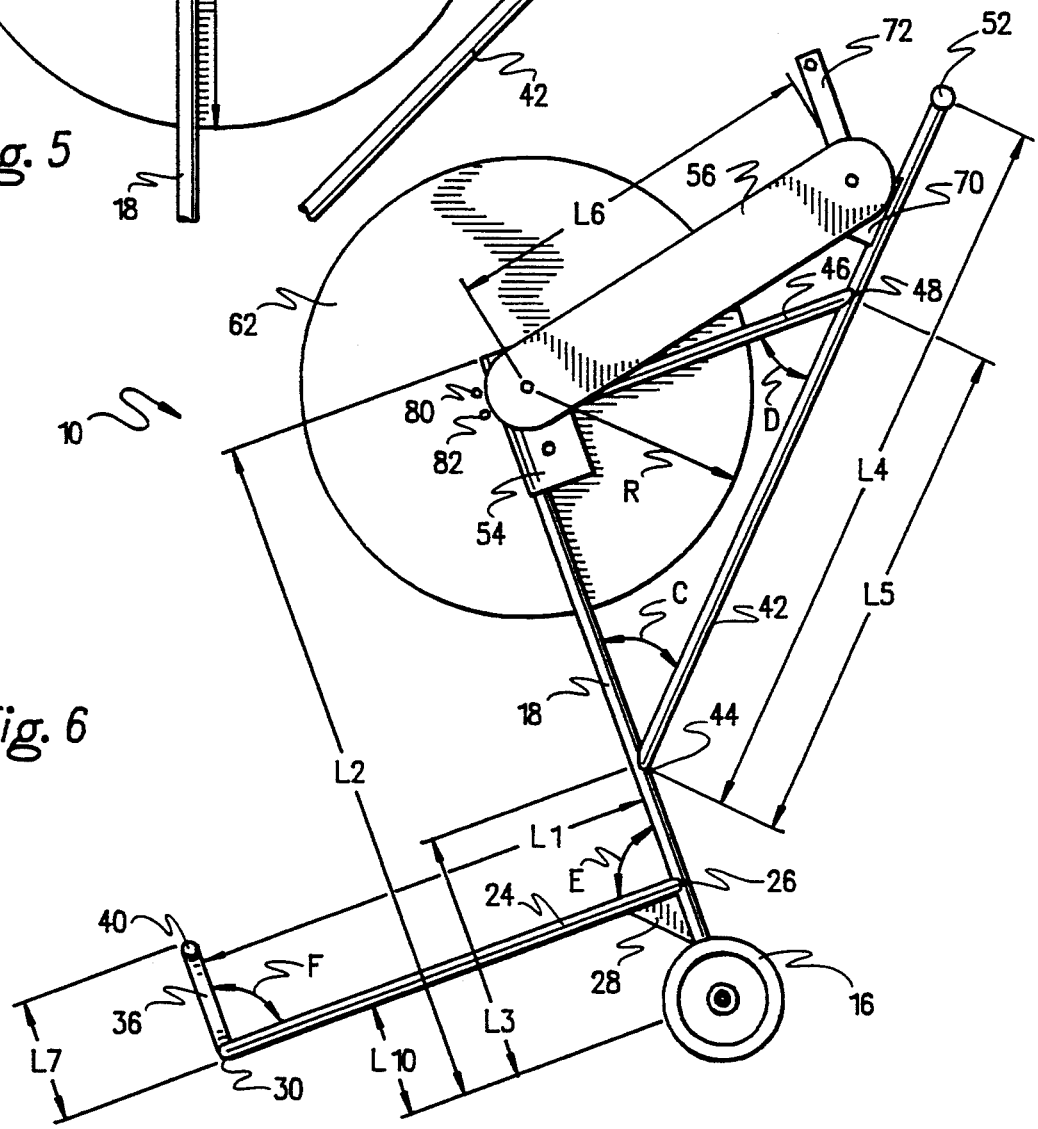
FIG. 6 is a side elevational view of the hose reel cart according to the present invention.

In use, one end of a hose H is slipped between the pins 80 and 82, as shown in FIG. 2, with the body of the hose disposed within the guide channel formed by hose guide members 32, 36, and 40. The user then manually rotates the crank arm 72 by manipulation of the handle 74 to coil the hose in an overlying flattened condition, as shown in FIG. 1. It should be noted that the slight incline of the reel 62 from vertical causes the coiled portion of the hose H to rest against the surface of the reel 62, and prevents the hose from tending to fall outwardly off of the pins 80 and 82. During this process, the user may hold the cart stationary, or may alternatively wheel the cart along the ground as the hose is coiled. During this process, the downwardly inclined orientation of the cart and hose guide support 24, as shown in FIG. 6, in conjunction with abutment of the hose H with the support bar 32, causes the hose H to flatten and drain. After complete coiling of the hose H, the entire hose may be slipped off of the reel 62 and conventionally positioned for storage or transportation. By virtue of the ergonometric design of the hose reel cart 10 of the instant invention, the user need not bend nor stoop during the rolling process or while removing the coiled hose, thus minimizing the potential for back strain or other injury.

The following chart, with reference to the drawings, provides preferred angular and linear dimensions of a preferred embodiment of hose reel cart of the present invention.

| Reference Character | Dimension |
|---|---|
| L1 | 24.0 in. |
| L2 | 32.5 in. |
| L3 | 9.0 in. |
| L4 | 40.0 in. |
| L5 | 25.5 in. |
| L6 | 21.5 in. |
| L7 | 4.0 in. |
| L8 | 20.0 in. |
| L9 | 12.0 in. |
| L10 | 6.0 in. |
| L11 | 9.0 in. |
| L12 | 6.0 in. |
| R | 12.0 in. |
| C | 45 deg. |
| D | 45 deg. |
| E | 90 deg. |
| F | 90 deg. |
| G | 5–10 deg. |
| H | 45 deg. |

As described previously, the tubular frame of the hose reel cart 10 may be formed from metal tubes connected by welding. Alternatively, one or more of the frame members may be detachably secured by a variety of conventional fasteners to allow the cart 10 to be totally or partially disassembled for transportation. As an alternative to metal, suitable rigid synthetic materials may also be employed, such as plastic, graphite composites, fiberglass, etc. Additionally, the various frame members need not necessarily comprise tubular members, but may comprise solid or hollow frame members having a wide variety of different shapes and configurations.

Further, while the hose reel mechanism has been described in conjunction with a wheeled cart, it should be noted that various features of the disclosed reel mechanism might be employed apart from the disclosed frame and cart. For example, the hose reel mechanism of the invention might be mounted on a fire truck or support vehicle, or at a fire station. Also, while the present invention is principally intended for use in connection with the rolling of fire hoses, the device might also be employed for coiling a variety of other hoses, or other elongated flexible sheet material such as tape.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. In a device including a reel and means for rotating the reel to coil an elongated flattened flexible member thereon, the improvement comprising:

means for releasably connecting at least a portion of said flexible member to said reel;

means for coiling said flexible member upon itself into a substantially circular roll; and means for permitting rapid removal of said circular roll from said reel without uncoiling said flexible member.

2. The device of claim 1, wherein said reel comprises a planar member disposed at an acute angle relative to vertical.

3. The device of claim 1, wherein said means for releasably connecting comprises a pair of substantially parallel pins including conically tapered portions extending outwardly from said reel and dimensioned to allow insertion of an elongated flexible member therebetween.

4. The device of claim 3, wherein said pins are offset from an axis of rotation of said reel.

5. The device of claim 1, further comprising:

a frame including a standard extending substantially vertically upwardly from a substantially transverse axle;

a pair of wheels on said axle disposed on opposite sides of said standard for moving said device along a ground surface;

a hose guide support member extending forwardly from a connection with said standard, said hose guide support member disposed substantially perpendicular to said standard; and a hose guide on a forward end of said hose guide support member, said hose guide defining an open-ended rectangular channel dimensioned to receive and at least partially constrain a hose therein and including a hose support bar dimensioned and disposed for supporting a hose in underlying relation, said hose support bar dimensioned and disposed for ground engagement for supporting said device.

6. The device of claim 5, further comprising:

a rear frame member extending obliquely rearwardly from a connection with said standard;

said standard, said hose guide support member, and said rear frame member all disposed in a common vertically extending plane; and a hand grip on said rear frame member.

7. A hose reel cart, comprising:

a frame including a standard extending substantially vertically upwardly from a substantially transverse axle;

a pair of wheels on said axle disposed on opposite sides of said standard for moving said hose reel cart along a ground surface;

a reel mounted on said standard at an elevation sufficient to allow manual removal of a coiled hose from said reel by an individual in an upright posture, said reel mounted for rotation about an axis extending substantially transverse to said standard, said reel comprising a planar member disposed at an acute angle in the range of 5 through 10 degrees relative to vertical in an upright operative orientation of said cart, said reel mounted on said standard in a position offset from a centerline of said frame to balance the weight of a hose coiled on said reel;

a hose coupler for temporarily securing a hose to said reel including a pair of substantially parallel tapered pins extending outwardly from said reel and spaced apart to allow insertion of a hose therebetween and to allow rapid removal of a rolled hose from said reel;

a hand crank operably connected by a chain and sprocket drive mechanism for rotating said reel to coil a hose on said reel;

a hose guide support member extending forwardly from a connection with said standard, said hose guide support member disposed substantially perpendicular to said standard;

a hose guide on a forward end of said hose guide support member, said hose guide defining an open-ended rectangular channel dimensioned to receive and at least partially constrain a hose therein and including a hose support bar dimensioned and disposed for supporting a hose in underlying relation, said hose support bar dimensioned and disposed for ground engagement for supporting said hose reel cart;

a rear frame member extending obliquely rearwardly from a connection with said standard;

said standard, said hose guide support member, and said rear frame member all disposed in a common vertically extending plane; and a hand grip on said rear frame member.

8. A hose reel cart, comprising:

a frame including a substantially upright standard, an axle secured adjacent a lower end of said standard and extending substantially transverse to said standard, a hose guide support member extending substantially forwardly from said standard, said hose guide support member disposed substantially transverse to said standard and to said axle, and a rear frame member extending rearwardly from a connection with said standard;

a reel mounted for rotation on said standard about an axis substantially transverse to said standard at an elevation sufficient to allow manual removal of a coiled hose from said reel by an individual in an upright posture;

a pair of wheels mounted on said axle on opposite sides of said standard;

a handle on said rear frame member; and a hose guide mounted on a forward end of said hose guide support member dimensioned and disposed to at least partially constrain a hose therein and including a hose support bar dimensioned and disposed for supporting a hose in underlying relation and for ground engagement for supporting said hose reel cart.

9. The hose reel cart of claim 8, wherein said reel comprises a substantially planar member disposed at an acute angle in the range of 5 through 10 degrees relative to vertical in an upright operative orientation of said cart.

10. The hose reel cart of claim 8, wherein said reel is mounted on said standard in a position offset from a centerline of said frame to balance the weight of a hose coiled on said reel.

11. The hose reel cart of claim 8, further comprising a hose coupler for temporarily securing a hose to said reel including a pair of members extending outwardly from said reel and spaced apart to allow insertion of a hose therebetween and to allow rapid removal of a rolled hose from said reel.

12. The hose reel cart of claim 11, wherein said pair of members comprise substantially parallel tapered pins.

13. The hose reel cart of claim 8, further comprising a hand crank operably connected by a chain and sprocket drive mechanism for rotating said reel to coil a hose on said reel.

14. The hose reel cart of claim 8, wherein said hose guide defines an open-ended rectangular channel dimensioned to receive and at least partially constrain a hose therein.

15. The hose reel cart of claim 8, wherein said standard, said hose guide support member, and said rear frame member are all disposed in a common vertically extending plane.

* * * * *